US006657145B1

(12) United States Patent
Huang

(10) Patent No.: US 6,657,145 B1
(45) Date of Patent: Dec. 2, 2003

(54) ILLUMINATIVE LIGHTING MECHANISM FOR VEHICLE TOGGLE SWITCH LEVER EXTENSIONS

(75) Inventor: Nan Huang Huang, Rancho Palos Verdes, CA (US)

(73) Assignee: Grand General Accessories Manufacturing, Inc., Compton, CA (US)

( * ) Notice: Subject to any disclaimer, the term of this patent is extended or adjusted under 35 U.S.C. 154(b) by 0 days.

(21) Appl. No.: 10/295,557

(22) Filed: Nov. 14, 2002

(51) Int. Cl.[7] ..... H01H 9/00
(52) U.S. Cl. ..... 200/313; 200/314
(58) Field of Search ..... 200/310, 313, 200/314, 329, 335, 341, 345, 510, 557, 330, 331, 315; 362/555

(56) References Cited

U.S. PATENT DOCUMENTS 3,717,759 A * 2/1973 Rousseau ..... 362/186
3,924,117 A * 12/1975 Brindley ..... 362/191
4,669,990 A * 6/1987 McDermott ..... 441/16
5,140,116 A * 8/1992 Schmitt-Walter ..... 200/314
5,473,521 A * 12/1995 Minshall ..... 362/205
5,636,729 A * 6/1997 Wiciel ..... 200/181
6,428,182 B1 * 8/2002 Maglica ..... 362/205
6,474,834 B2 * 11/2002 Lai ..... 362/206
6,554,449 B2 * 4/2003 Maglica ..... 362/205

* cited by examiner

*Primary Examiner*—Lincoln Donovan
*Assistant Examiner*—Lisa N Klaus
(74) *Attorney, Agent, or Firm*—Thomas I. Rozsa; Tony D. Chen

(57) ABSTRACT

A toggle switch lever extension for use in conjunction with a toggle switch lever. It has an elongated main body having a hollow bore with an upper portion for housing a self-powered illuminative lighting mechanism and a lower portion for receiving the toggle switch lever. The lighting mechanism includes a lens, a lamp, at least one battery and a switch assembled in an electrically connected and operative fashion such that the lamp is powered by the at least one battery and can be switched on or off by the switch. The illuminative lighting mechanism can be switched on or off to provide improved visibility of the toggle switch lever without interfering with normal operation of the toggle switch lever.

12 Claims, 2 Drawing Sheets

ILLUMINATIVE LIGHTING MECHANISM FOR VEHICLE TOGGLE SWITCH LEVER EXTENSIONS

BACKGROUND OF THE INVENTION

1. Field of the Invention

The present invention generally relates to the field of accessories for trucks or the like. More particularly, the present invention relates to the field of toggle switches lever extensions used in commercial trucks or the like.

2. Description of the Prior Art

Toggle switch lever extensions are widely used in commercial trucks and the like. Existing toggle lever extensions are generally constructed mainly for the purpose of extending the length of toggle switch levers. However, one of the disadvantages of prior art toggle switch lever extensions is that they are difficult to locate at night.

It is therefore desirable to have a very efficient and also very effective design and construction of a new and unique vehicle toggle lever extension which is capable of rapidly adapting to different types of toggle switch levers, long enough to be easily reached by the driver or operator of the vehicle, and more importantly, can be illuminated and hence visible at night.

SUMMARY OF THE INVENTION

The present invention is an illuminative lighting mechanism for vehicle toggle switch lever extensions.

It is an object of the present invention to provide a vehicle toggle switch lever extension that can be illuminated for good visibility at night.

It is also an object of the present invention to provide a vehicle toggle switch lever extension with an illuminative lighting mechanism that can be switched on or off depending on the visibility condition.

It is another object of the present invention to provide an illuminative lighting mechanism for vehicle toggle switch lever extensions with an on/off push-button that moves in a direction that is independent of the directions of the toggle switch lever movement so that the operation of switching on/off the illuminative lighting mechanism of the toggle switch lever extension will not cause the toggle switch itself being switched.

It is an additional object of the present invention to provide a vehicle toggle switch lever extension with an illuminative lighting mechanism that is powered by self-contained internal batteries.

It is a further object of the present invention to provide an illuminative lighting mechanism for vehicle toggle switch lever extensions where the decorative lens, light bulb and batteries can all be quickly and easily exchanged or replaced.

Described generally, the present invention is a toggle switch lever extension for use in conjunction with a toggle switch lever. The toggle switch lever extension includes a generally elongated main body having a top end and a bottom end, the main body being hollow at least at an upper portion proximate to and accessible from its top end for housing a self-contained unit of an illuminative lighting mechanism, and also at a lower portion proximate to and accessible from its bottom end for receiving the toggle switch lever to extend the length of the toggle switch lever so that it can be more easily reached. The toggle switch lever extension also includes a cap fastened to the top end of the main body.

The illuminative lighting mechanism of the toggle switch lever extension includes the self-contained unit and a coil spring. The self-contained unit includes a lens, a small lamp, at least one battery and a push-button switch assembled in an electrically connected and operative fashion such that the small lamp is powered by the at least one battery and can be switched on or off by the push-button switch.

The coil spring of the illuminative lighting mechanism is placed inside the main body under the self-contained unit for biasing the self-contained unit upwardly, such that a top illuminative surface of the lens extends through a top opening of the cap, and that the push-button switch is in a normally disengaged condition.

The illuminative lighting mechanism can be switched on or off by depressing the top illuminative surface of the lens to cause the self-contained unit to move downwardly such that the push-button switch is engaged to switch the small lamp on or off, where such downward motion for switching the illuminative lighting mechanism on or off does not interfere with normal operation of the toggle switch lever.

The present invention illuminative lighting mechanism for vehicle toggle switch lever extensions has many unique features and important advantages. It provides good visibility for a toggle switch lever at night. It can also be on or off whenever desirable and will not interfere with the switching movement of the toggle switch lever.

In addition, the present invention illuminative lighting mechanism is self-powered by internal batteries, and the decorative lens, light bulb and batteries of the illuminative lighting mechanism can all be quickly and easily exchanged or replaced.

Moreover, the vehicle toggle switch lever extensions incorporating the present invention illuminative lighting mechanism can be used interchangeably on many vehicle toggle switch lever.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
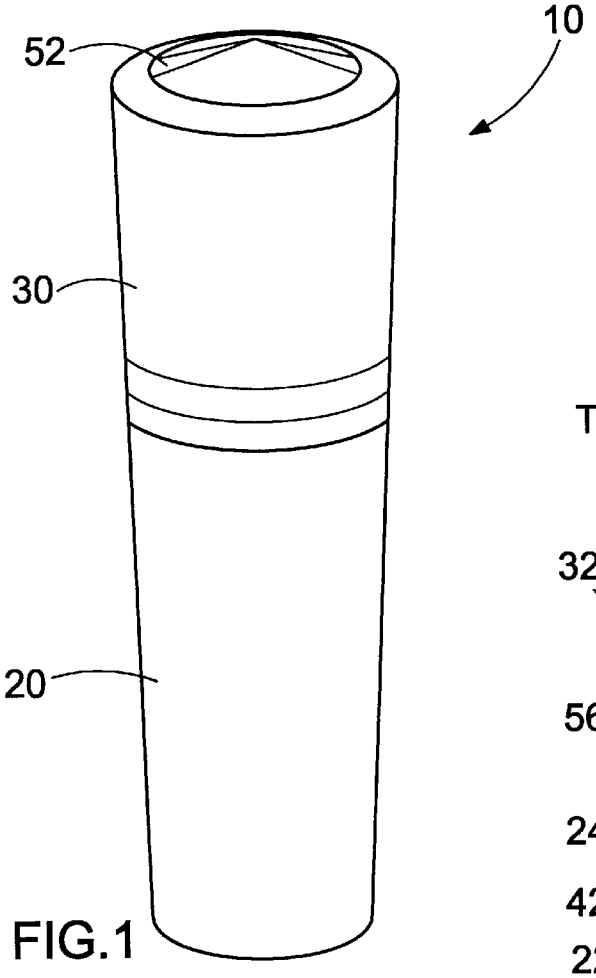
FIG. 1 is a perspective view of the present invention illuminative lighting mechanism for vehicle toggle switch lever extensions.
Figure 3:
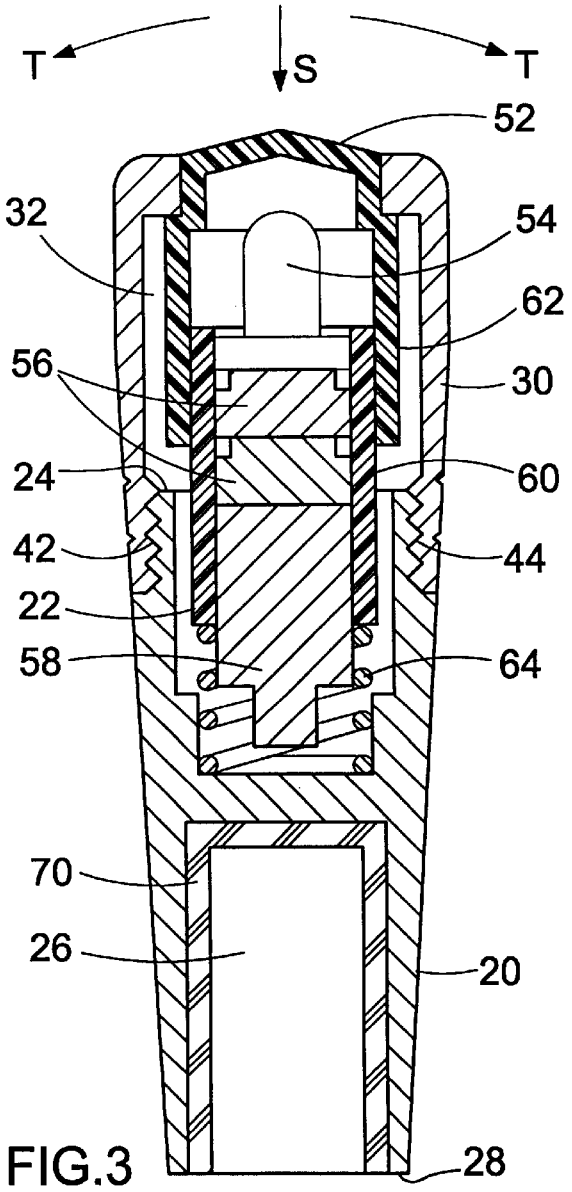
FIG. 3 is a side elevation view of the present invention illuminative lighting mechanism for vehicle toggle switch lever extensions, showing the illuminative lighting mechanism assembled.
Figure 2:
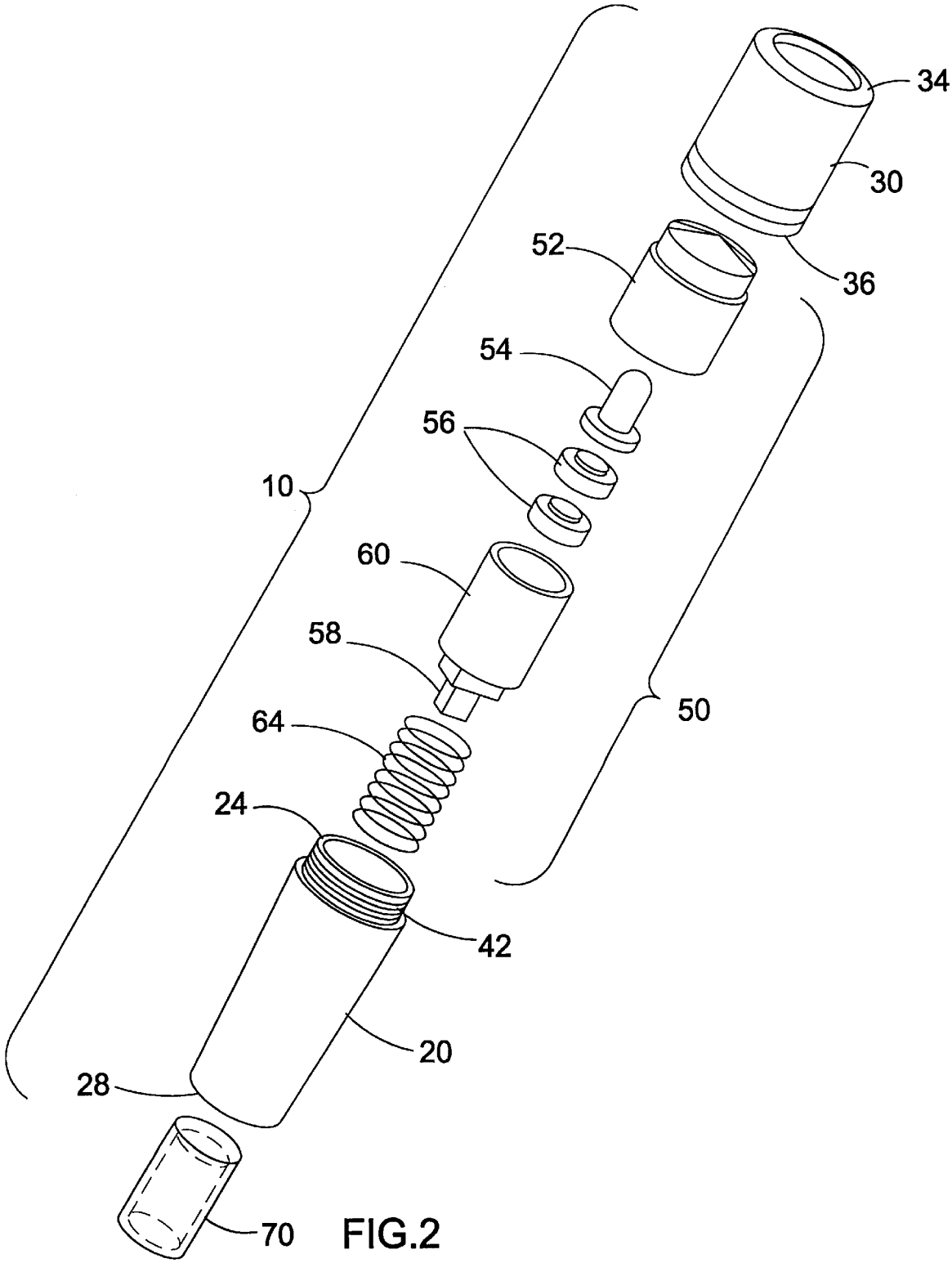
FIG. 2 is an exploded perspective view of the present invention illuminative lighting mechanism for vehicle toggle switch lever extensions, showing the illuminative lighting mechanism disassembled.

Referring to FIGS. 1 through 3, there is shown at 10 a vehicle toggle switch lever extension incorporating the present invention illuminative lighting mechanism. The toggle switch lever extension 10 can be installed over a toggle switch lever (not shown) of a vehicle.

The present invention toggle switch lever extension 10 includes a generally elongated tapered cylindrical shaped main body 20 and a cap 30. The generally tapered cylindrical shaped main body 20 has an upper hollow chamber 22 which opens at the top end 24 of the main body 20, and a lower hollow chamber 26 which opens at its bottom end 28 of the main body 20.

The cap 30 also has a generally cylindrical shaped configuration with a hollow chamber 32 which opens at both the top end 34 of the cap 30 and the bottom end 28 of the cap 30. As a result, the hollow chamber 32 forms a through bore of the cap 30.

The top end 24 of the main body 20 is provided with external screw threads 42, and the bottom end 36 of the cap 30 is provided with internal screw threads 44, such that the cap 30 can be screwed onto the main body 20. When the cap 30 is screwed onto the main body 20, the upper hollow chamber 22 of the main body 20 and the hollow chamber 32 of the cap 30 forms an internal compartment for housing the components of an illuminative lighting mechanism 50 of the present invention.

As shown in details in FIG. 2, the present invention illuminative lighting mechanism 50 includes a lens 52, a small lamp or light bulb or light emitting diode (LED) 54, one or more button shaped batteries 56, and a push-button switch 58. The small lamp 54, batteries 56 and push-button switch 58 are all assembled inside a cylindrical shaped sleeve 60, where the small lamp 54 is snugly press-fitted at the top end of the sleeve 60 and the push-button switch 58 is snugly press-fitted at the bottom end of the sleeve 60, sandwiching the batteries 56. The lens 52 is then snugly press-fitted over the top end of the sleeve 60. As a result, the lens 52, the small lamp 54, the batteries 56, the push-button switch 58 and the sleeve 60 forms a self-contained unit 62, which is then placed inside the internal compartment formed by the upper hollow chamber 22 of the main body 20 and the hollow chamber 32 of the cap 30.

As further shown in FIG. 3, when the self-contained unit 62 is placed inside the internal compartment of the main body 20 and the cap 30, a coil spring 64 is placed under the self-contained unit 62. As the cap 30 is screwed onto the main body 20, the coil spring 64 is slightly depressed to urge the self-contained unit 62 upwardly, such that the top illuminative surface of the lens 52 extends through the top opening 34 of the cap 30, and a gap is maintained between switch 58 and the bottom of the upper hollow chamber 22 of the main body 20.

The lower hollow chamber 26 of the main body 20 is used for receiving the outer end portion of a vehicle toggle switch lever (not shown). A hollow insert 70 made of a resilient material is snugly press-fitted inside the lower hollow chamber 26 of the main body 20 to accommodate and conform to the exterior shape of various vehicle toggle switch levers so that the present invention toggle switch lever extension 10 can be interchangeably fitted on various toggle switch levers used in vehicles.

Once the present invention toggle switch lever extension 10 is fitted onto a vehicle toggle switch lever, it extends the length of the toggle switch lever so that it can be more easily reached by an operator. When desired, the operator can slightly depress the top surface of the lens 52 along the direction of the downward arrow S shown in FIG. 3, which causes the self-contained unit 62 to move downwardly such that the push-button switch 58 engages with and is depressed by the bottom of the upper hollow chamber 22 of the main body 20, which in turn causes the present invention illuminative lighting mechanism 50 to be switched on or off. This motion along the direction of the downward arrow S does not cause the toggle switch itself to be switched, as the switching motion for that purpose is sideways along the directions of arrow T shown in FIG. 3.

The present invention illuminative lighting mechanism for vehicle toggle switch lever extensions has many advantages. It provides a lighting mechanism for vehicle toggle switch lever extensions so that they can be visible at night. It can also has a self-contained on/off switch so that it can be switched on or off as the user desires. The on/off switch of the lighting mechanism does not interfere with the switching movement of the toggle switch lever. The present invention illuminative lighting mechanism is powered by self-contained internal batteries.

In addition, the decorative lens, light bulb and batteries of the present invention illuminative lighting mechanism can all be quickly and easily exchanged or replaced. Furthermore, the vehicle toggle switch lever extension having the present invention illuminative lighting mechanism can be interchangeably used as a universal vehicle toggle switch lever extension.

Defined in detail, the present invention is a toggle switch lever extension for use in conjunction with a toggle switch lever, comprising: (a) a generally elongated tapered cylindrical shaped main body having an upper hollow chamber which opens at a top end of the main body, and a lower hollow chamber which opens at a bottom end of the main body; (b) a cap having a generally cylindrical shaped configuration with a hollow chamber which opens at both a top end of the cap and a bottom end of the cap such that the hollow chamber forms a through bore of the cap; (c) means for fastening the cap at it's the bottom end to the main body at its the top end such that the upper hollow chamber of the main body and the hollow chamber of the cap forms an internal compartment for housing a self-contained unit of an illuminative lighting mechanism; (d) the self-contained unit of the illuminative lighting mechanism comprising a lens, a small lamp, at least one battery and a push-button switch all assembled inside a cylindrical shaped sleeve in an electrically connected and operative fashion such that the small lamp is powered by the at least one battery and can be switched on or off by the push-button switch, where the small lamp is snugly press-fitted at a top end of the sleeve and the push-button switch is snugly press-fitted at a bottom end of the sleeve, sandwiching the at least one battery, and the lens is snugly press-fitted at the top end of the sleeve; (e) the illuminative lighting mechanism further comprising a coil spring placed under the self-contained unit inside the internal compartment for biasing the self-contained unit upwardly, such that a top illuminative surface of the lens extends through the top opening of the cap, and a gap is maintained between the push-button switch and a bottom of the upper hollow chamber of the main body; and (f) an insert made of a resilient material and snugly press-fitted inside the lower hollow chamber of the main body for receiving and accommodating the toggle switch lever to extend the length of the toggle switch lever so that it can be more easily reached; (g) whereby the illuminative lighting mechanism can be switched on or off by depressing the top illuminative surface of the lens to cause the self-contained unit to move downwardly such that the push-button switch engages with the bottom of the upper hollow chamber of the main body to switch the small lamp on or off, where such downward motion for switching the illuminative lighting mechanism on or off does not interfere with normal operation of the toggle switch lever.

Defined broadly, the present invention is a toggle switch lever extension for use in conjunction with a toggle switch lever, comprising: (a) a generally elongated main body having a top end and a bottom end, the main body being hollow at least at an upper portion proximate to and accessible from its top end for housing a self-contained unit of an illuminative lighting mechanism, and also at a lower portion proximate to and accessible from its bottom end for receiving the toggle switch lever to extend the length of the toggle switch lever so that it can be more easily reached; (b) a cap fastened to the top end of the main body; (c) the self-contained unit of the illuminative lighting mechanism comprising a lens, a small lamp, at least one battery and a push-button switch assembled in an electrically connected and operative fashion such that the small lamp is powered by the at least one battery and can be switched on or off by the push-button switch; and (d) the illuminative lighting mechanism further comprising means for biasing the self-contained unit upwardly, such that a top illuminative surface of the lens extends through a top opening of the cap, and that the push-button switch is in a normally disengaged condition; (e) whereby the illuminative lighting mechanism can be switched on or off by depressing the top illuminative surface of the lens to cause the self-contained unit to move downwardly such that the push-button switch is engaged to switch the small lamp on or off, where such downward motion for switching the illuminative lighting mechanism on or off does not interfere with normal operation of the toggle switch lever.

Defined more broadly, the present invention is a toggle switch lever extension for use in conjunction with a toggle switch lever, comprising: (a) an elongated main body having a hollow bore with an upper portion for housing a self-powered illuminative lighting mechanism and a lower portion for receiving the toggle switch lever; and (b) the illuminative lighting mechanism comprising a lens, a lamp, at least one battery and a switch assembled in an electrically connected and operative fashion such that the lamp is powered by the at least one battery and can be switched on or off by the switch; (c) whereby the illuminative lighting mechanism can be switched on or off to provide improved visibility of the toggle switch lever without interfering with normal operation of the toggle switch lever.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A toggle switch lever extension for use in conjunction with a toggle switch lever, comprising:

a. a generally elongated tapered cylindrical shaped main body having an upper hollow chamber which opens at a top end of the main body, and a lower hollow chamber which opens at a bottom end of the main body;

b. a cap having a generally cylindrical shaped configuration with a hollow chamber which opens at both a top end of the cap and a bottom end of the cap such that the hollow chamber forms a through bore of the cap;

c. means for fastening said cap at its said bottom end to said main body at its said top end such that said upper hollow chamber of said main body and said hollow chamber of said cap forms an internal compartment for housing a self-contained unit of an illuminative lighting mechanism;

d. said self-contained unit of said illuminative lighting mechanism comprising a lens, a small lamp, at least one battery and a push-button switch all assembled inside a cylindrical shaped sleeve in an electrically connected and operative fashion such that said small lamp is powered by said at least one battery and can be switched on or off by said push-button switch, where the small lamp is snugly press-fitted at a top end of the sleeve and the push-button switch is snugly press-fitted at a bottom end of the sleeve, sandwiching the at least one battery, and the lens is snugly press-fitted at the top end of the sleeve;

e. said illuminative lighting mechanism further comprising a coil spring placed under said self-contained unit inside said internal compartment for biasing said self-contained unit upwardly, such that a top illuminative surface of said lens extends through said top opening of said cap, and a gap is maintained between said push-button switch and a bottom of said upper hollow chamber of said main body; and f. an insert made of a resilient material and snugly press-fitted inside said lower hollow chamber of said main body for receiving and accommodating said toggle switch lever to extend the length of said toggle switch lever so that it can be more easily reached;

g. whereby said illuminative lighting mechanism can be switched on or off by depressing said top illuminative surface of said lens to cause said self-contained unit to move downwardly such that said push-button switch engages with said bottom of said upper hollow chamber of said main body to switch said small lamp on or off, where such downward motion for switching said illuminative lighting mechanism on or off does not interfere with normal operation of said toggle switch lever.

2. The toggle switch lever extension as claimed in claim 1, wherein said means for connecting said cap to said main body comprises internal screw threads provided at said bottom end of said cap and external screw threads provided at said top end of said main body.

3. A toggle switch lever extension for use in conjunction with a toggle switch lever, comprising:

a. a generally elongated main body having a top end and a bottom end, the main body being hollow at least at an upper portion proximate to and accessible from its top end for housing a self-contained unit of an illuminative lighting mechanism, and also at a lower portion proximate to and accessible from its bottom end for receiving said toggle switch lever to extend the length of said toggle switch lever so that it can be more easily reached;

b. a cap fastened to said top end of said main body;

c. said self-contained unit of said illuminative lighting mechanism comprising a lens, a small lamp, at least one battery and a push-button switch assembled in an electrically connected and operative fashion such that said small lamp is powered by said at least one battery and can be switched on or off by said push-button switch; and d. said illuminative lighting mechanism further comprising means for biasing said self-contained unit upwardly, such that a top illuminative surface of said lens extends through a top opening of said cap, and that said push-button switch is in a normally disengaged condition;

e. whereby said illuminative lighting mechanism can be switched on or off by depressing said top illuminative surface of said lens to cause said self-contained unit to move downwardly such that said push-button switch is engaged to switch said small lamp on or off, where such downward motion for switching said illuminative lighting mechanism on or off does not interfere with normal operation of said toggle switch lever.

4. The toggle switch lever extension as claimed in claim 3, wherein said cap has a bottom rim provided with internal screw threads, and said top end of said main body is provided with external screw threads, for fastening said cap to said main body.

5. The toggle switch lever extension as claimed in claim 3, wherein said biasing means comprises a coil spring placed under said self-contained unit inside said main body.

6. The toggle switch lever extension as claimed in claim 3, further comprising an insert made of a resilient material and placed inside said lower hollow portion of said main body for accommodating said toggle switch lever.

7. A toggle switch lever extension for use in conjunction with a toggle switch lever, comprising:

a. an elongated main body having a hollow bore with an upper portion for housing a self-powered illuminative lighting mechanism and a lower portion for receiving said toggle switch lever; and b. said illuminative lighting mechanism comprising a lens, a lamp, at least one battery and a switch assembled in an electrically connected and operative fashion such that said lamp is powered by said at least one battery and can be switched on or off by said switch;

c. said self-contained unit of said illuminative lighting mechanism comprising a lens, a small lamp, at least one battery and a push-button switch all assembled inside a cylindrical shaped sleeve in an electrically connected and operative fashion such that said small lamp is powered by said at least one battery and can be switched on or off by said push-button switch, where the small lamp is snugly press fitted at a top end of the sleeve and the push-button switch is snugly press-fitted at a bottom end of the sleeve, sandwiching the at least one battery, and the lens is snugly press-fitted at the top end of the sleeve;

d. said illuminative lighting mechanism further comprising a coil spring placed under said self-contained unit inside said internal compartment for biasing said self-contained unit upwardly, such that a top illuminative surface of said lens extends through said top opening of said cap, and a gap is maintained between said push-button switch and a bottom of said upper hollow chamber of said main body; and e. an insert made of a resilient material and snugly press-fitted inside said lower hollow chamber of said main body for receiving and accommodating said toggle switch lever to extend the length of said toggle switch lever so that it can be more easily reached;

f. whereby said illuminative lighting mechanism can be switched on or off by depressing said top illuminative surface of said lens to cause said self-contained unit to move downwardly such that said push button switch engages with said bottom of said upper hollow chamber of said main body to switch said small lamp on or off, where such downward motion for switching said illuminative lighting mechanism on or off does not interfere with normal operation of said toggle switch lever.

8. The toggle switch lever extension as claimed in claim 7, further comprising a cap fastened to a top end of said main body.

9. The toggle switch lever extension as claimed in claim 8, wherein said cap has a bottom rim provided with internal screw threads, and said main body has a top end provided with external screw threads, for fastening said cap to said main body.

10. The toggle switch lever extension as claimed in claim 7, wherein said illuminative lighting mechanism further comprising biasing means for maintaining said switch in a normally disengaged condition.

11. The toggle switch lever extension as claimed in claim 10, wherein said biasing means comprises a coil spring placed under said self-contained unit inside said main body.

12. The toggle switch lever extension as claimed in claim 7, further comprising an insert made of a resilient material and placed inside said lower portion of said hollow bore of said main body for accommodating said toggle switch lever.

* * * * *